United States Patent [19]

Craddy

[11] 3,935,774

[45] Feb. 3, 1976

[54] MOUNTING DEVICES FOR A BLADE OF A ROTARY CUTTING MACHINE

[75] Inventor: Richard Adrian Craddy, Bristol, England

[73] Assignee: Masson Scott Thrissell Engineering Limited, Bristol, England

[22] Filed: June 21, 1974

[21] Appl. No.: 481,865

[30] Foreign Application Priority Data

June 22, 1973 United Kingdom ..... 29660/73

[52] U.S. Cl. ..... 83/355; 83/345; 83/699; 83/356.3

[51] Int. Cl.² ..... B26D 1/36; B26D 4/72

[58] Field of Search ..... 83/699, 355, 345, 356.3

[56] References Cited

UNITED STATES PATENTS

| | | | |
|---|---|---|---|
| 2,216,208 | 10/1940 | Michon | 83/699 X |
| 3,709,077 | 1/1973 | Trogan | 83/345 X |
| 3,797,766 | 3/1974 | Hennen | 83/356.3 X |

*Primary Examiner*—Willie G. Abercrombie

*Attorney, Agent, or Firm*—Young & Thompson

[57] ABSTRACT

A blade mounting device for a rotary cutting machine in which the blade is formed with a groove or shoulder to receive a locating element which acts to hold the blade readially in a groove of a cutting cylinder and also adjusts the position of the blade in a perpendicular direction. The locating element is adjusted by means of an eccentric mounted on a pivot, the eccentric having a hexagonal head for adjustment purposes, and a clamping screw to fix the eccentric in position. The locating element may itself be provided with several abutment surfaces for varying the radial position of the blade. A resilient backing strip is inserted on the opposite side of the blade.

8 Claims, 11 Drawing Figures

MOUNTING DEVICES FOR A BLADE OF A ROTARY CUTTING MACHINE

This invention relates to the mounting of knife blades on rotary cutting machines. The invention may be applied to either or both blades of a so-called double rotary machine, having two rotary drums each provided with a knife or blade which cooperates as the two drums rotate in synchronism to cut a web of material passing between the drums by a shearing action. The invention may also be applied to a so-called single rotary machine having one drum with a knife attached to its surface and a lower stationary knife attached to a base part or frame of the machine. In the latter case the cutting action is more in the nature of a crushing action on the material of the web as opposed to the shearing action of a double rotary machine.

Conventional methods of mounting the knives or blades on the drums or bases of such machines are somewhat bulky, complex and expensive to manufacture and assemble, and involve somewhat laborious procedures for adjusting the knives accurately so that they cooperate to provide an effective cutting action. Also the range of adjustment, and the security of location, is often inadequate. It is an object of the invention accordingly to provide an improved method and device for mounting the blades of such cutting machines which will simplify the manufacture and assembly, and enable accurate adjustment and positive location of the blades.

Broadly stated from one aspect the invention consists in a mounting device for a blade of a rotary cutting machine, comprising an eccentric or cam pivotally mounted on a support, and arranged to bear directly or through a locating or clamping element on a part of the blade, and means for fixing the eccentric or cam in the desired position of adjustment.

According to a preferred feature of the invention the eccentric or cam, and/or the locating or clamping element, is arranged to locate the blade in two mutually perpendicular directions.

In a particular preferred construction the eccentric or cam is mounted on a screw-threaded member which acts as a pivot and also provides the means for adjustably positioning the said eccentric or cam.

From another aspect the invention consists in a mounting device for a blade of a rotary cutting machine, including a screw-threaded member arranged to cooperate with the blade to locate the blade in a direction perpendicular to its plane, and also in a direction within the plane of the blade and perpendicular to its cutting edge.

In any case the mounting device may include resilient or adjustable means, opposing the action of the blade locating or clamping means.

Figure 1:
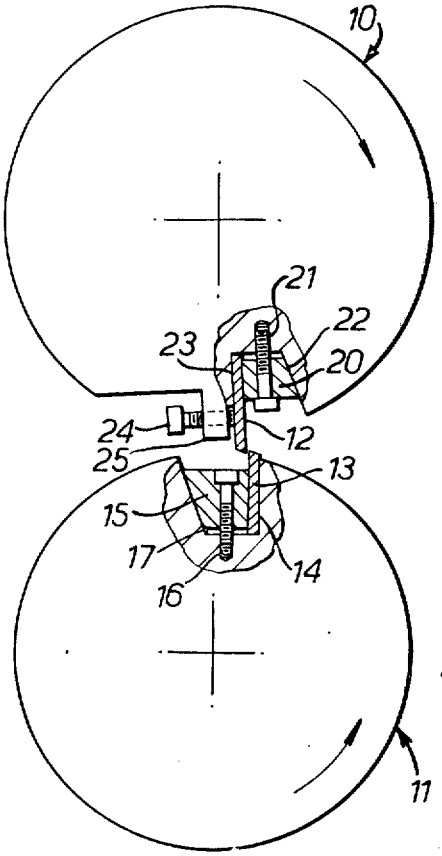
FIG. 1. PRIOR ART
Figure 2:
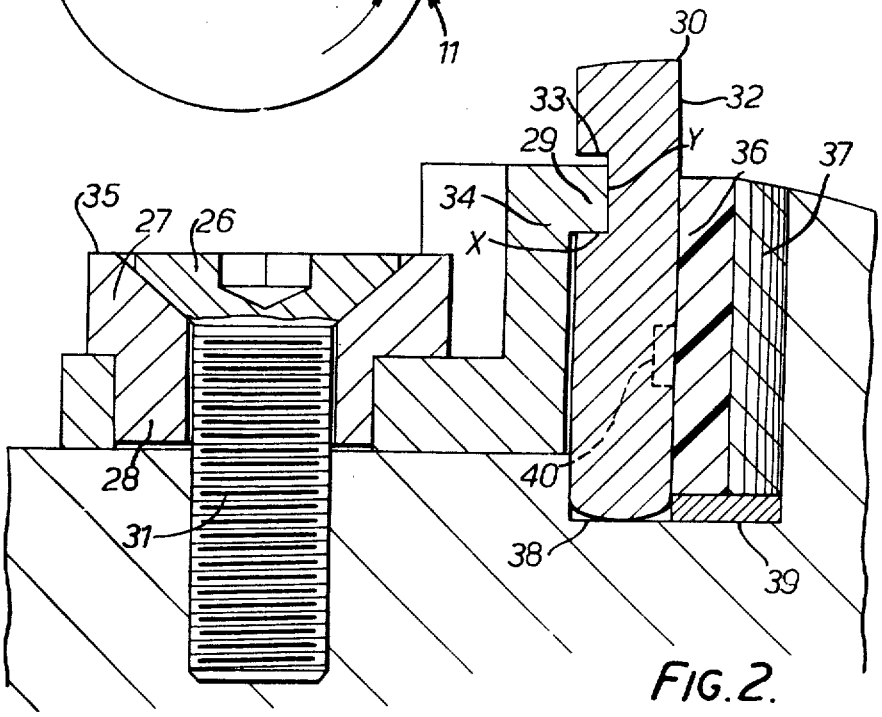
Figure 3:
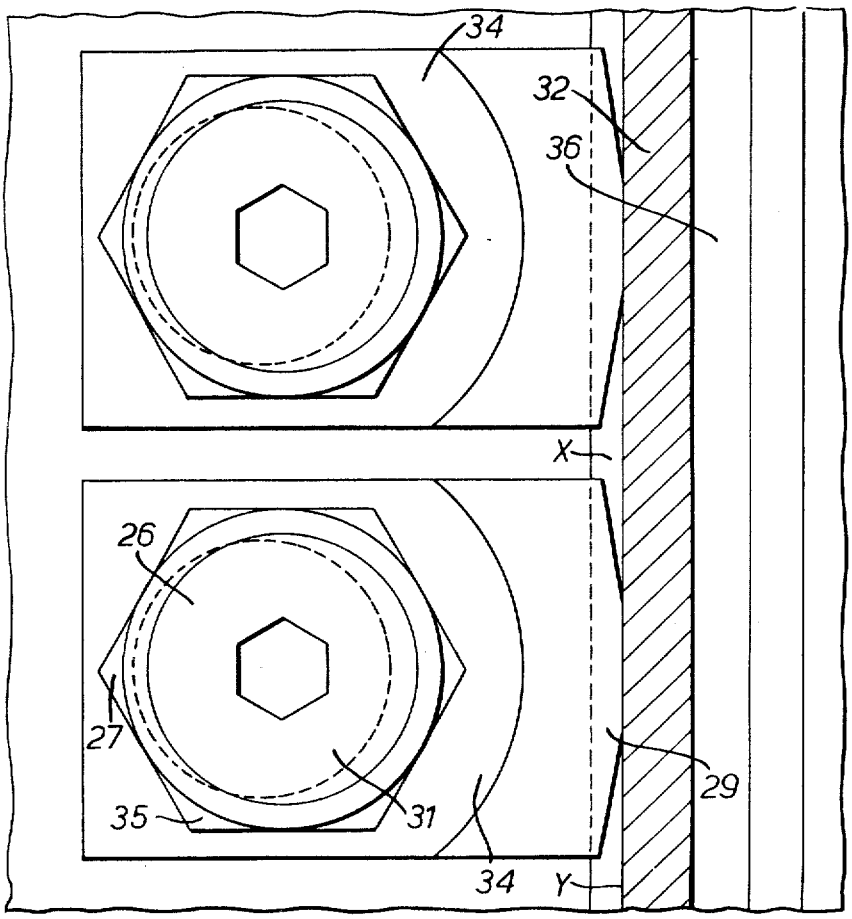
Figure 4:
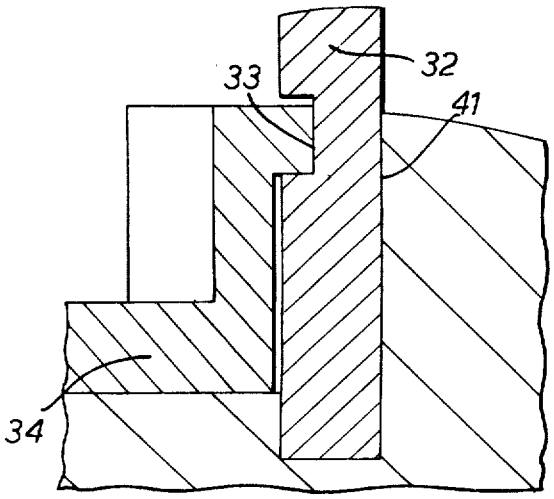
Figure 5:
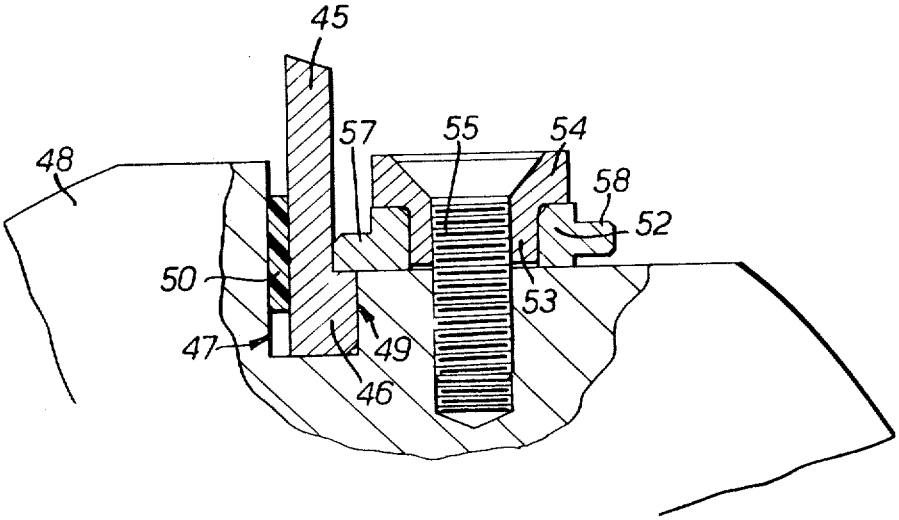
Figure 6:
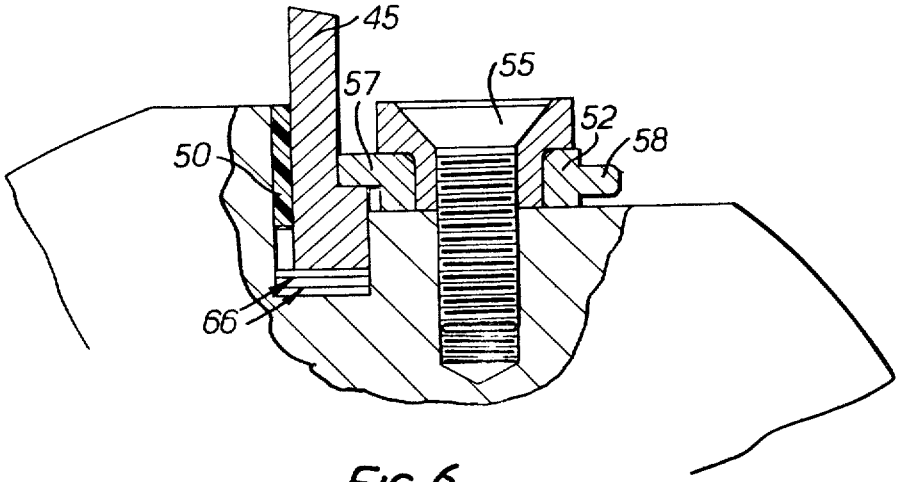
Figure 7:
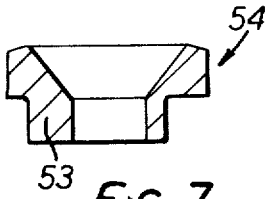
Figure 9:
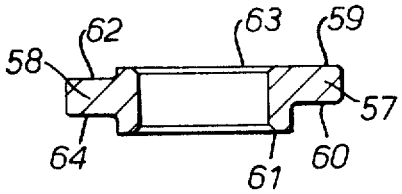
Figure 8:
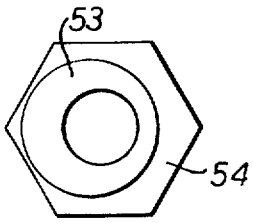
Figure 10:
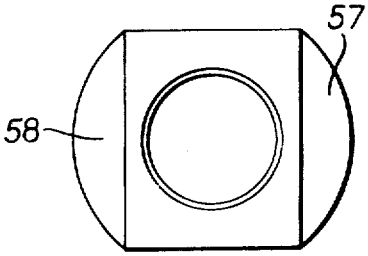
Figure 11:
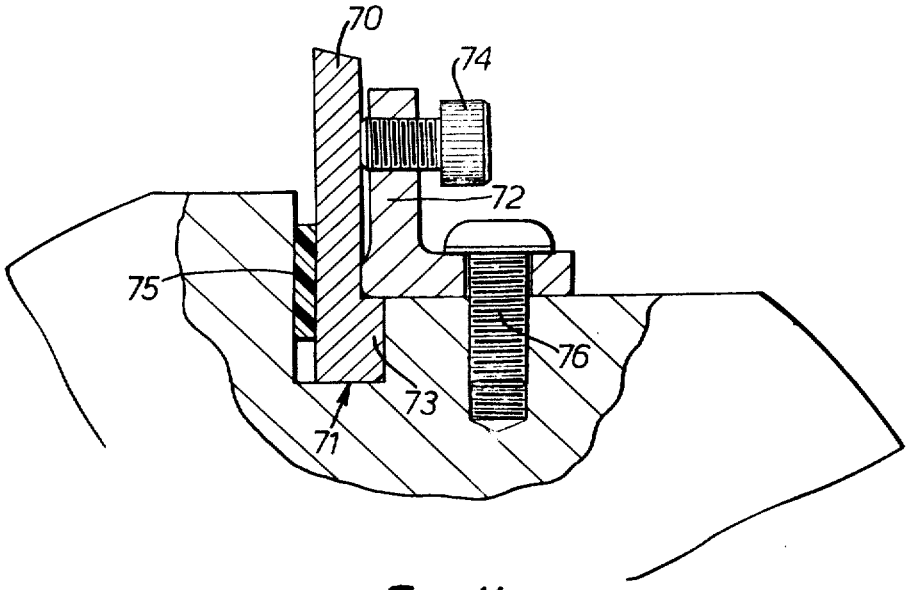

The invention may be performed in various ways and one specific embodiment with a number of possible modifications will now be described by way of example, with reference to the accompanying drawings, in which:

FIG. 1 is a diagrammatic sectional view through the two drums of a conventional double rotary cutting machine, showing the method of mounting the knife blades, FIG. 2 is a sectional side elevation on an enlarged scale showing a mounting device for a blade on a rotary drum, in accordance with the invention, FIG. 3 is a simple plan view on the mounting device illustrated in FIG. 2, FIG. 4 is a similar fragmentary sectional elevation illustrating parts of a modified form of blade mounting device according to the invention, FIG. 5 is a fragmentary sectional elevation illustrating another blade mounting device in accordance with the invention, FIG. 6 is a similar sectional elevation of the same blade mounting device in a different position of adjustment, FIGS. 7 and 8 are respectively a sectional elevation and an underneath plan view of the eccentric adjusting member of FIGS. 5 and 6, FIGS. 9 and 10 are respectively a sectional elevation and an underneath plan view of the blade retaining element of FIGS. 5 and 6, and FIG. 11 is a fragmentary sectional elevation of yet another form of blade mounting device according to the invention.

Referring first to a conventional double rotary cutting machine as illustrated in FIG. 1, this consists of two power-driven rotary drums or cylinders 10,11, each provided with a cutting knife blade 12,13, projecting generally radially from its cylindrical surface. The blade 13 of the bottom drum 11 may be referred to as the fixed blade for reasons to be explained, although of course the blade is continuously rotated with the drum 11. This blade 13 is located against a back face 14 of a groove formed in the cylindrical surface of the drum and is fixed in position by means of a row of knife wedges 15 which are clamped in the tapered groove by wedge screws 16, the wedges bearing against an inclined flank 17 of the groove so as to exert a lateral clamping force on the knife blade 13. The back face 14 provides the datum surface for the two knife blades.

The knife blade 12 of the upper drum 10 is located in a somewhat similar manner by a row of top knife wedges 20 anchored by wedge screws 21 within a groove having a tapered flank 22. The wedges bear against the inner edge portion of the knife blade forcing this blade against the opposite back face 23 of the groove.

Some limited adjustment of the position of the cutting edge of the blade 12 is provided by a series of knife adjusting screws 24 which are passed through screwthreaded apertures in a flange 25 on the drum and bear against the knife blade at points close to its cutting edge so as to deflect the knife blade as required in order to align the cutting edge accurately with the edge of the fixed knife 13. In this way the two knife blades can be arranged to meet accurately and provide a true shearing action on the intervening web of material at all points across their width. It will be appreciated that the knife blades 12 and 13 will normally be positioned helically across the surfaces of the drums, though in some cases the blades may be positioned parallel with the axes of rotation. The adjustment of the upper knife blade 12 is required principally by reason of errors in the flatness or straightness of the blades, and the degree of adjustment may vary across the length of each blade.

Referring now to the blade mounting and adjusting device illustrated in FIGS. 2 and 3, the knife blade 32 is provided with a groove 33 parallel to its length and adjacent its outer cutting edge 30, this groove providing two perpendicular surfaces X and Y from which the blade is located, as will be explained. The adjusting and locating device comprises a clamping element 34

(there being a number of such elements individually mounted along the length of the blade) provided with a projecting nib 29 which extends into the groove 33 and bears against both faces X and Y. The nib 29 has a curved cut-away profile as illustrated in FIG. 3. This clamping element has a circular aperture to receive the stem 28 of an eccentric or cam 35, which has an enlarged hexagonal head 27 and is formed with a slightly oversize central drilling by which it is mounted on a screw-threaded bolt or stud 31 having a counter-sunk head 26 which provides a frictional clamping force on the eccentric 35. The axis of this screw-threaded stud 31 is offset from the central axis of the stem 28 of the eccentric. Thus it will be seen that rotary adjustment of the eccentric 35, for example by applying a spanner to its hexagonal head 27, will cause movement of the clamping element 34 towards and away from the knife blade, i.e., towards and away from the surface Y on the blade. The eccentric 35 also bears down on a top surface of the clamping element 34 and thus the nib 29 of the clamping element also engages with the surface X on the blade. In any required position of adjustment the eccentric is fixed by tightening the clamping stud 31.

The system illustrated in FIGS. 2 and 3 is designed to provide not only location but also adjustment of the cutting edge of the knife and for this purpose the face of the knife blade 32 remote from the clamping member 34 is arranged to butt against a resilient backing element 36 formed for example of polyurethane or other elastomer and located in a groove formed in the rotary drum or cylinder. Thus it will be seen that by applying lateral thrust through the eccentric 35 the position and profile of the cutting edge 30 of the knife can be adjusted along its length, the element 36 being compressed accordingly. In order to provide increased range of adjustment the resilient backing element 36 may be supplemented by a series of removable backing elements or shims 37, formed of a resilient material or for example of metal, and so arranged that they can readily be removed in order to provide for the required degree of adjustment.

The backing elements 36,37 may be held in position merely by reason of the clamping load exerted on the knife blade by the eccentric 35. Alternatively the element 36 may be located by attaching this element either to the knife blade 32 or to the opposite abutment surface on the drum itself. In the latter case the positions of the items 36 and 37 will be transposed from the positions shown in FIG. 2. The attachment of the backing elements to the knife blade or drum may be by a bonding process, or for example by providing one or more protrusions 40 which locate in a corresponding groove or a number of bores formed in the blade. The laminations or backing elements 37 may or may not be attached to the backing element 36. When an adjustable clamping force is applied to the blade, the blade may tilt slightly about its base, and to accommodate this the blade may be rounded or relieved at its base edge as illustrated at 38.

FIG. 4 illustrates a simplified construction incorporating a clamping and adjusting device as described above, with the blade 32 abutting against a fixed surface 41 on the drum cylinder. This system may be used for mounting the blade of a lower drum of a double rotary cutting machine as illustrated in FIG. 1, or a fixed knife blade mounted statically on the base of a single rotary machine.

If it is required that the lateral movement of the base of the knife should be restricted, this can be achieved either by locating the base edge in a groove, as illustrated in FIG. 4, or providing an additional locating strip 39 at the base of the groove as illustrated in FIG. 2.

Referring now to the modified form of blade mounting device illustrated in FIGS. 5 to 10, the blade 45 is formed with a shoulder 46 at its lower end which is located in a groove 47 formed in the drum cylinder 48. The blade is pressed against the face 49 of the groove by a resilient backing strip 50 formed of some elastomeric material, the strip being compressed to provide accurate location. The blade is adjustably located by a locating member 52 which is somewhat equivalent in function to the retaining member 34 in FIG. 2. This locating member 52 has a central aperture receiving a circular stem 53 of an eccentric adjusting member 54 having a hexagonal head so that it can be adjusted by a spanner. The eccentric has an offset central oversize drilling by which it is mounted on a screw-threaded stud 55 mounted in the drum cylinder 48 on an axis slightly offset from the central axis of the stem 53. As in the embodiment of FIG. 2 the eccentric 54 can thus be turned and fixed in any angular position to determine the lateral position of the locating member 52, i.e., in a horizontal direction as seen in FIG. 5.

In this embodiment the locating device is particularly designed to accommodate changes in the radial dimension of the blade 45 (i.e., vertically in FIG. 5) as a result of regrinding after prolonged use. In conventional drum cutting machines after a blade has been reground shims are inserted below the blade to maintain its cutting edge at the same radial distance from the rotary axis. This, however, presents difficulties in the blade-adjusting device which must accommodate these variations in the radial position of the blade. In this embodiment of the invention the problem is solved by forming the locating member 52 with two laterally projecting flanges 57,58 (see FIGS. 9 and 10). The flange 57 has one face 59 flush with the end surface 63 of the member 52 and another face 60 which is spaced from the opposite face 61 by a distance 3S, where S is a small value such as 0.025 inches, arbitrarily selected in this example as the maximum permitted tolerance or variation in the radial position of the blade tip from the correct designed radial position. S is also equivalent to one fourth of the total "grinding allowance," i.e., the total amount of metal that can be removed from the blade before it must be discarded. The other flange 58 has one face 62 which is spaced from the adjacent end face 63 by a distance S and an opposite face 64 which is spaced from the other end surface 61 by a distance 2S. The member 52 can be turned through 180° around the stem 53 to bring either one of the flanges 57,58 into engagement with the shoulder 46 on the blade, and the member 52 can also be removed, inverted, and replaced, giving two further positions of vertical adjustment, for locating the tip of the blade 45 in a radial direction. This arrangement is particularly suitable for cutting machines in which the blades are so designed that an appreciable tolerance, or variation in radial position of the blade tip is acceptable. Initially a new blade is set up as shown in FIG. 5 with the shoulder 46 engaged by the "zero" face 59 of flange 57. When the knife wears it is reground, possibly several times, until the change in radial position of the blade tip is nearly equal to the tolerance value S. A shim 66, of thickness S, is then inserted below the blade, and the member 52 is rotated to bring the surface 62 of the flange 58 into contact with the shoulder 46. This restores the blade tip approximately to the correct radial position. The procedure can be repeated several times until eventually there are three shims 66 below the blade, and the shoulder 46 is located by the surface 60 on the flange 57, as illustrated in FIG. 6.

It will be noted that these adjustments in the radial position of the blade do not affect the lateral adjustment determined by the rotary position of the eccentric member 54. Also it will be seen from FIG. 10 that the two flanges 57,58 are curved in profile, so that the flanges do not interfere with the longitudinal bending of the blade.

In the embodiment of FIG. 11, the blade 70 is located in a groove 71 formed in the cutting cylinder by means of a locating member 72, of L section, arranged to bear against a shoulder 73 on the blade. The blade can be tilted or twisted by means of an adjusting screw 74 mounted in the vertical limb of the member 72, and arranged to force the blade against a compressible elastomeric pad 75. The member 72 is located vertically by a screw 76 engaging the horizontal limb of the member. Adjustment of the radial position of the blade in this example is obtained by inserting thin shims below the blade 70, and also below the locating member 72.

I claim:

1. A mounting device for mounting a blade on a rotary drum of a rotary cutting machine, the blade lying generally radial to the axis of the drum and extending lengthwise of the drum, the sides of the blade defining generally radial flanks, the device comprising an eccentric pivotally mounted on the drum on a generally radial axis, and arranged to bear against a said radial flank of the blade, to locate the blade in a radial direction and also to vary the position of the blade in a tangential direction with respect to the drum, and means for fixing the eccentric in the desired position of adjustment.

2. A blade mounting device according to claim 1, in which the eccentric is mounted on a screwthreaded member which acts as a pivot and also provides the means for adjustably positioning the said eccentric

3. A blade mounting device according to claim 1, wherein said eccentric acts in a tangential direction on one side of said blade, and including resilient backing means acting against the opposite side of said blade.

4. A blade mounting device according to claim 1, including adjustable shim means, located against the inner radial edge of said blade, for positively determining the radial position thereof.

5. A blade mounting device according to claim 1, and a locating member arranged to engage a surface on the blade and provide location of the blade in a radial direction relative to the drum axis, in which the locating member has a plurality of locating surfaces at different radial positions relative to the drum axis, and means for securing said locating member to said drum in any of a plurality of different positions so as to bring any selected one of said locating surfaces into engagement with the blade.

6. A blade mounting device according to claim 5, in which the locating member is pivotally mounted on a generally radial axis with respect to the drum axis.

7. A blade mounting device according to claim 5, in which the locating member is removable, and is so formed that on being inverted and replaced a further locating surface becomes operable at a radial position different from the position of the original locating surface.

8. A blade mounting device for a blade of a rotary cutting machine, including a part with a groove to receive one edge of the blade, means for clamping the said blade in the groove, adjusting means for determining the position of the cutting edge of the blade in a direction perpendicular to the plane of the blade, and resilient backing means interposed between said blade and a side wall of said groove and opposing the force exerted by said adjusting means.

* * * * *